US006513915B1

(12) United States Patent
Komatsu et al.

(10) Patent No.: US 6,513,915 B1
(45) Date of Patent: Feb. 4, 2003

(54) VARIABLE DOT INK-JET PRINTER

(75) Inventors: Atsushi Komatsu, Katano (JP); Akihiko Namba, Osaka (JP); Masayuki Okano, Kawanishi (JP); Yosihiro Tomita, Osaka (JP); Osamu Kawasaki, Kyotanabe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/427,026

(22) Filed: Oct. 26, 1999

(30) Foreign Application Priority Data

Oct. 27, 1998 (JP) ..... 10-306042

(51) Int. Cl.[7] ..... B41J 2/045
(52) U.S. Cl. ..... 347/68
(58) Field of Search ..... 347/68, 54, 20, 347/47, 65, 75, 45, 63, 44, 55

(56) References Cited

U.S. PATENT DOCUMENTS 4,801,955 A * 1/1989 Miura et al. ..... 347/55
5,278,584 A * 1/1994 Keefe et al. ..... 347/63
5,703,630 A * 12/1997 Murakami et al. ..... 347/45
6,270,190 B1 * 8/2001 Ahn ..... 347/44

FOREIGN PATENT DOCUMENTS

JP 5-261925 10/1993 ..... B41J/2/05

* cited by examiner

*Primary Examiner*—John S. Hilten
*Assistant Examiner*—K. Feggins
(74) *Attorney, Agent, or Firm*—Smith, Gambrell & Russell, LLP

(57) ABSTRACT

A variable dot ink-jet printer having an ejection flow passage with a decrease in sectional area from an ejection port toward the interior of the flow passage and up to a boundary. A draw-in part draws an ink front position in the interior of the flow passage. A push-out part pushes out the ink front position outside the flow passage. When ejecting a small ink drop, the ink front position is drawn at a place having an increase in sectional area by the draw-in part. The ink is pushed outward by the push-out part at such a speed as to exit from an edge of an area of the boundary on the ejection port side.

30 Claims, 11 Drawing Sheets

VARIABLE DOT INK-JET PRINTER

BACKGROUND OF THE INVENTION

1. Field of the Invention

The present invention relates to an ink-jet printer with the gradation expression power of image enhanced by making the size of ink dots formed on a recording medium variable.

2. Related Art of the Invention

In recent years, with the spread of a personal computer, the demand for a printer, as the output device of a personal computer has increased in leaps and bounds. Especially, in these several years, the occupied ratio of color printers has grown and a speedup and a higher image quality is greatly required for color image printing.

Then, in a conventional ink jet printer, a higher image quality has been implemented by a smaller ink drop ejected from an printer head and a higher dot density on a recording medium. Hereinafter, referring the drawings, one embodiment of piezo type ink ejection using dielectrics will be described.

FIG. 19 shows a conventional ink-jet printer and Numeral 21 denotes a U-shaped flow passage frame, in which a flow passage 22 is formed by closing the opening face with a vibrating plate 25. To this vibrator plate 25, a piezoelectric body 26 with an electrode 27 formed on both sides is fastened and is configured so as to enlarge or contract the volume of the flow passage 22 by the bending of the vibrator plate 25 due to the expansion and contraction of the piezoelectric body 26 under application of a voltage.

On a gradual application of a voltage to the piezoelectric body 26, the piezoelectric body 26 gradually deforms in the outer direction of the flow passage 22 to enlarge the volume of the flow passage 22 and sucks ink into the flow passage 22 through the ink supply port 24. Thereafter, on suddenly removing the applied voltage, the piezoelectric body 26 is suddenly restored to the original shape and the volume of the flow passage 22 is suddenly contracted. As a result, the ink in the flow passage 22 is suddenly pressurized and this pressurized ink is ejected through an ejection port 23 provided on the flow passage frame 21 as ink drops 28.

Besides, as another method for upgrading the image quality, a process of changing the mass or diameter of ink drops is thought of (e.g. Japanese Patent Laid-Open No. 5-261925). Use of a process of changing the diameter of ink drops permits the gradation to be expressed with a change in ink drops ejected from one ejection port, thus enabling images of low-resolution and high image quality to be implemented.

If an attempt is made to implement a high image quality in the former structure of an ink-jet printer, however, it is required to stably eject small ink drops in plenty. This is connected to the upgrade of image resolution and to obtain the same printing speed as formerly, a method such as a increase in the density and number of ejection ports or a speedup of repeated ejections becomes necessary. This increase in the density and number of ejection ports or this speedup of repeated ejections causes a rise in manufacturing cost and a shortening of durable years and is not necessarily satisfied. There was a limit to the high-level compatibility between image quality upgrade and speedup of ink-jet printers.

Also, in a method for changing the mass and diameter of ink drops ejected from the ejection port, no satisfaction is necessarily obtained from the viewpoint of manufacturing, durability or density increase of ejection ports.

Furthermore, a printing head for ink-jet printers disclosed in Japanese Patent Laid-Open No. 5-261925 is based on a method for enlarging the sectional area of the front end in an ejection port and for changing the mass or diameter of ink drops in a simple configuration; however, since a way to change the front end position of ink ejection by use of a certain means and to give the ejection energy to ink by use of another means is employed, it was difficult to eject ink drops of smaller diameter than the size of a small area portion present in the flow passage inside the ejection port and further it was difficult to eject ink of larger diameter than an ejection port of large area.

SUMMARY OF THE INVENTION

The present invention intends to solve these problems and its purpose is to provide an ink-jet printer in which the mass or diameter of ink drops is variable corresponding to the need for image quality upgrade and speedup.

The present invention relates to an ink-jet printer for ejecting ink drops from the ejection port. An ink-jet printer according to a first aspect of the present invention comprises a flow passage whose sectional area decreases from the ejection port toward the inside of the ink flow passage, becomes equal to the minimum and then increases further toward the inside of the flow passage, means for drawing the ink front end position inside the flow passage, and means for pushing the ink front end position outside.

Since the present invention is configured so as to change the sectional area of a flow passage from the ejection port to the inside of the flow passage in the sequence of decrease and increase, first, when ejecting small ink drops, the ink front end is pulled from the flow passage of a smallest sectional area to the inner side of a larger sectional area by use of pull-in means and thereafter ink drops are ejected from a portion of a smallest sectional area by use of push-out means, thereby enabling smaller ink drops to be ejected than the sectional area.

Second, when ejecting large ink drops, the ink front end is pulled in to the flow passage of a small sectional area by use of pull-in means and thereafter ink drops are ejected from an ejection port of a larger sectional area by use of push-out means, thereby enabling larger ink drops to be ejected than the sectional area. In this manner, since the mass or the diameter of ink drops can be made larger than the ratio of sectional areas for ejection, an ink-jet printer capable of forming images of a higher gradation is obtained.

Besides, a second configuration of the present invention is such that the wall surface of a flow passage with an increase in sectional area from the portion of the minimum sectional area toward the interior of the flow passage is made hydrophilic.

In this second configuration, since the inner portion from that of the minimum sectional area diameter is made hydrophilic, the front end position of the ink comes at the portion of the minimum sectional area diameter at waiting conditions and then it becomes possible to eject large ink drops by use of means for ejecting drops without pull-in means in case of ejecting large ink drops.

Furthermore, a third configuration of the present invention is such that the wall surface of a flow passage with a decrease in sectional area from the ejection port toward the interior of the flow passage is made water-repellent.

In this third configuration, since the portion of a flow passage with a decrease in sectional area from the ejection port toward the interior of the flow passage is made water-repellant, the front end position of the ink at waiting condition comes at the portion of minimum sectional area and then it also becomes possible to eject large ink drops as the case of the second configuration. Besides, since the portion up to the ejection port is made water-repellant, it becomes possible to reduce the ink drops remaining near the ejection port, thus enabling large ink drops and large ink drops to be stably ejected.

DESCRIPTION OF SYMBOLS

Figure 1:
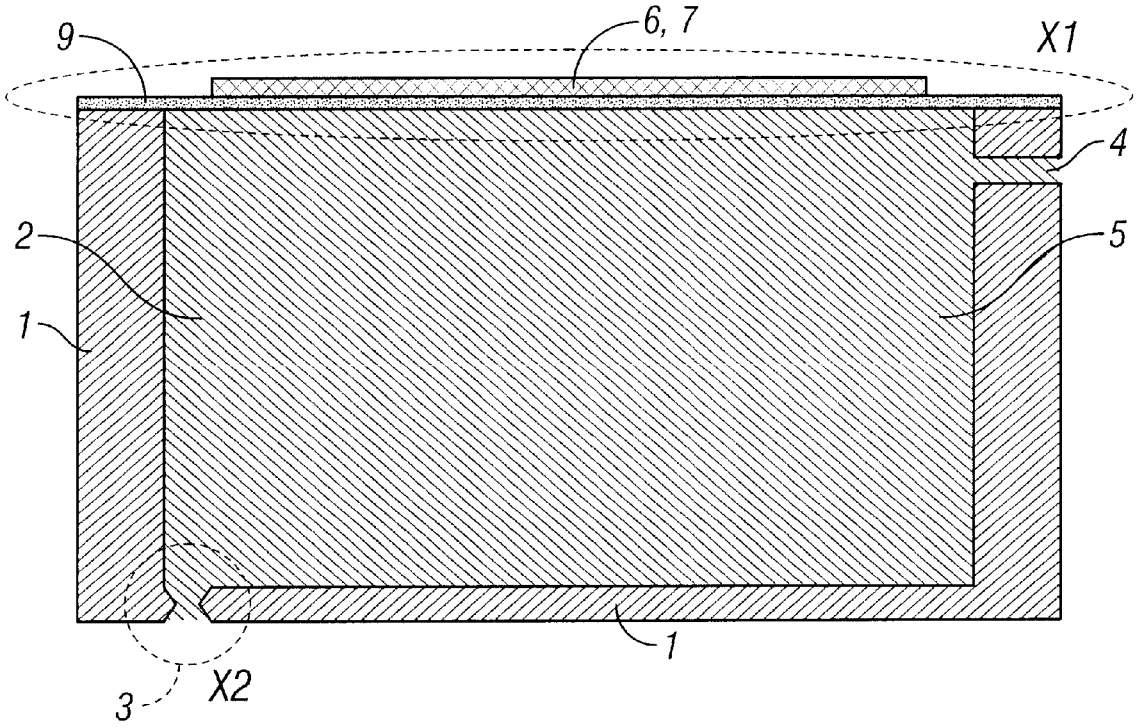
FIG. 1 is a schematic sectional view of an ink-jet printer according to one embodiment of the present invention.

1 . . . Flow passage frame
2 . . . Ink
3 . . . Ejection port
4 . . . Ink supply port
5 . . . Flow passage
6 . . . Draw-in means
7 . . . Push-out means
8 . . . Ink drop
9 . . . Vibrating plate
10 . . . Piezoelectric actuator

PREFERRED EMBODIMENTS OF THE INVENTION

Hereinafter, referring to the drawings, embodiments of the present invention will be described.

In the present invention, heating elements, piezoelectrics, pumps or the like are used for means for drawing the ink front end position inside the flow passage and means for pushing it outward.

Embodiment 1 of the present invention is an ink-jet printer comprising:

(a) an ejection flow passage with a decrease in sectional area from the ejection port toward the interior of the flow passage and until a boundary, that is until minimum sectional area, and with an increase from the boundary further toward the interior;

(b) draw-in means for drawing an ink front position in the interior of the flow passage; and (c) push-out means for pushing out said ink front position outside the flow passage;

wherein when ejecting a small ink drop, the ink front position is drawn at a place having said increase in sectional area by said draw-in means and thereafter said ink is pushed outward by the said push-out means at such a speed as to leave from an edge of a place of said minimum sectional area on said ejection port side.

Hereinafter, the embodiments of Embodiment 1 will be described.

Embodiment 1-1

FIG. 1 is a sectional view of an ink-jet printer configured by piezoelectrics used as means for drawing the ink front position into the inside of a flow passage 5 and means for pushing it outward according to Embodiment 1 of the present invention.

FIG. 1 shows a sectional view showing the stationary state of an ink-jet printer in which the surface tension and the outer pressure of ink 2 are balanced at the ejection port 3.

This ink-jet printer has two opening parts of an ink supply port 4 and an ejection port 3 on the flow passage frame 1, at the top of which a vibrating plate 9 is fastened. On this vibrating plate 9, a piezoelectric ceramic substrate as means 6 for drawing the ink front position into the interior and means 7 for pushing the ink front position to the outside is fastened. In this embodiment, PZT (lead zirconate titanate) is used as piezoelectric ceramic and a piezoelectric actuator 10 is formed of an unshown electrode on the top face of the PZT substrate and a stainless steel vibrating plate 9 situated on the bottom plate of the PZT substrate. Besides, this stainless steel vibrating plate 9 plays a role of bottom plate electrode of the PZT substrate.

Besides, the ink supply port 4 and the ink ejection port 3 can be communicate to each other and ink is supplied from the ink supply port, passes through an ink basin 2 in the flow path frame 1 and is ejected from the ejection port 3 to the outside as ink drops 8.

Next, the operating principle of this piezoelectric actuator 10 will be described using FIGS. 2(*a*) and (*b*).

Figure 2A:
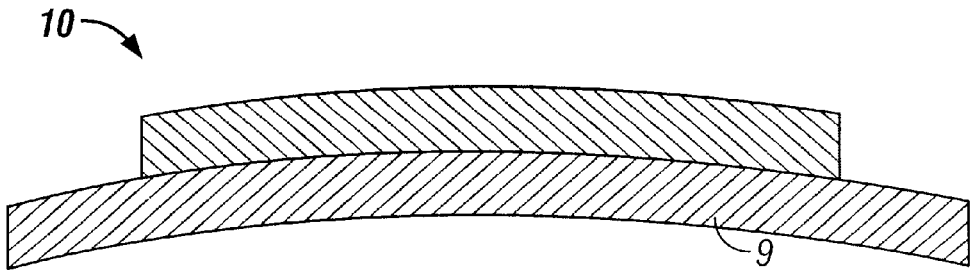
FIG. 2 is an illustration showing the operation of the piezoelectric actuator of FIG. 1.
Figure 2B:
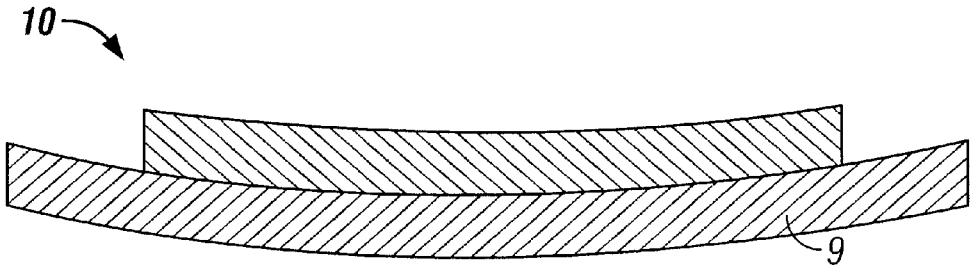

FIGS. 2(*a*) and (*b*) are enlarged views of the X1 region of FIG. 1. A piezoelectric ceramic substrate used as this actuator 10 is characterized in extending or contracting in the longitudinal direction of the substrate under application of a pulse voltage in the thickness direction. Accordingly, by sticking it to the vibrating plate 9 together, a bending displacement as shown in FIG. 2(*a*) or (*b*) can be obtained. For example, the piezoelectric actuator 10 extends if a positive pulse voltage is applied and it contracts if a negative pulse voltage is applied, so that the stuck vibrating plate undergoes a bending displacement upward or downward as shown in FIGS. 2(*a*) and (*b*).

Thus, on applying a pulse voltage so as to cause a bending displacement in the direction of FIG. 2(*a*), the ink front position retreats inside the flow passage 5 and the piezoelectric actuator 10 works as means for drawing the ink front position inward. On the other hand, on applying a pulse voltage so as to cause a bending displacement in the direction of FIG. 2(*b*), the ink front position advances outside the flow passage 5 and the piezoelectric actuator 10 works as means for pushing the ink front position outward. Besides, the displacement amount of the piezoelectric actuator 10 changes depending on an applied voltage.

Next, the ejecting operation will be described referring to FIGS. 3 and 4.

Figure 3A:
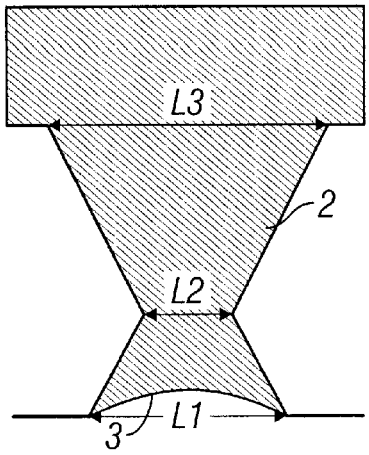
FIG. 3 is an illustration showing the ejecting operation in ejecting a small ink drop according to one embodiment of the present invention.
Figure 3B:
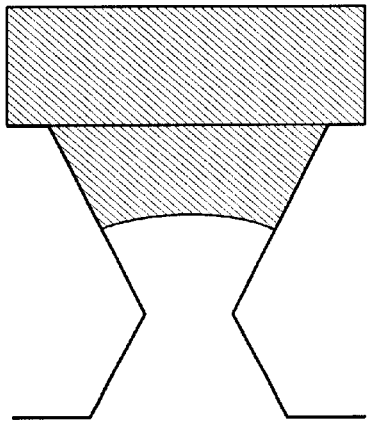
Figure 3C:
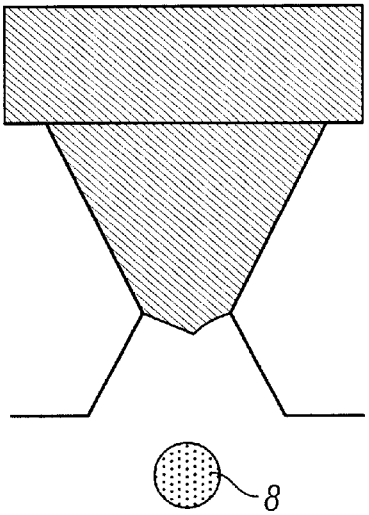

First of all, FIG. 3 is an enlarged view of the X2 part of FIG. 1 and shows the operating principle of for ejection of small ink drops from an ejection port 3. Besides, in this embodiment, the flow passage 5 is shaped in the sections of L1, L2 and L3 in diameter from the ejection port 3 toward the interior of flow passage 5.

FIG. 3(*a*) shows the initial state (stationary state) of the ink front at a time when no control is made over the ink front position. In this state, when a relatively large bending displacement is given as to lead the initial state to that shown in FIG. 3(*b*) under application of a pulse voltage to the piezoelectric actuator 10, the ink front position retreats to a further inner side of the flow passage 5 from the location of the passage diameter L2 as shown in FIG. 3(*b*). Then, by application of an inverted pulse voltage to the piezoelectric actuator 10, the bending displacement becomes as shown in FIG. 3(*c*), and an ink drop is ejected as small ink drop 8 from the section location of the flow passage L2 as shown in FIG. 3(*c*).

Figure 4A:
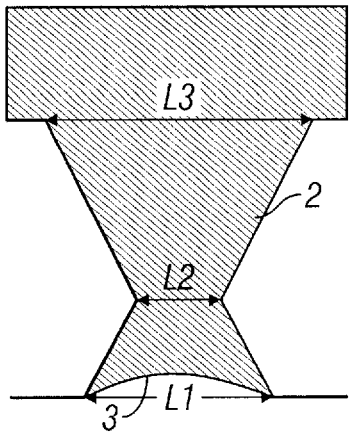
FIG. 4 is an illustration showing the ejecting operation in ejecting a large ink drop according to one embodiment of the present invention.
Figure 4B:
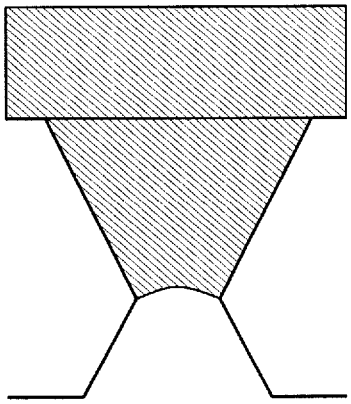
Figure 4C:
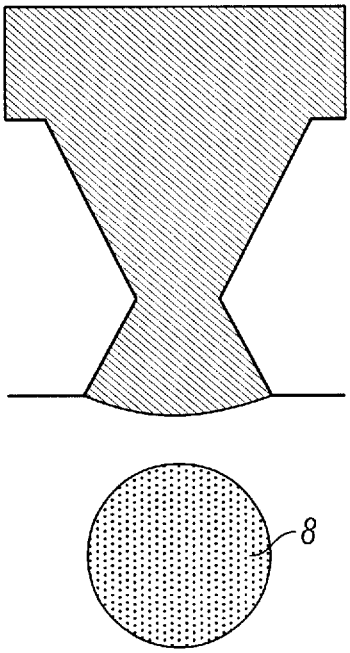

Secondly, FIG. 4 is an enlarged view of the X2 part of FIG. 1 as with FIG. 3 and shows the operating principle of for ejection of large ink drops from an ejection port 3. Besides, the passage shape near the ejection port is similar to that of FIG. 3.

FIG. 4(*a*) shows the initial state (stationary state) of the ink front at a time when no control is made over the ink front position. In this state, when a relatively small bending displacement is given as to lead the initial state to that shown in FIG. 4(*b*) under application of a pulse voltage to the piezoelectric actuator 10, the ink front position retreats to a position between the passage diameters L1 and L2. Then, by application of an inverted pulse voltage to the piezoelectric actuator 10, the bending displacement becomes as shown in FIG. 4(*c*), an ink drop is ejected as large ink drop 8 from the section location of the flow passage L1, i.e. form the ejection port 3 as shown in FIG. 4(*c*).

In this embodiment, for example, the shape of a flow passage near the ejection port is taken as L1: 120 $\mu$m, L2: 80 $\mu$m and L3: 250 $\mu$m and the driving conditions are defined as pulse voltage: ±25V and driving frequency: 3 kHz.

On driving operation by using a method for ejecting small ink drops under these conditions, a smaller ink drop of about 60 $\mu$m than the diameter of L2 is ejected from the section of the flow passage L2. This is considered as: by changing the section from L3 to L2, the flow speed is accelerated near the center of L2, the speed distribution is concentrated in the portion of a smaller section than the section of L2 and ink is ejected as a smallest ink drop.

Next, on driving operation by using a method for ejecting larger ink drops similarly, a larger ink drop of about 140 $\mu$m than the diameter of L1 is ejected from the section of the flow passage L1. This is considered as: by changing the section from L2 to L1, the speed distribution is widened over the section of L1 and as a result, ink is ejected as a larger ink drop.

According to this embodiment, as shown above, the ink front position can be arbitrarily changed by changing the pulse voltage or the wave form to be applied to the piezoelectric actuator 10. Besides, the size of an ink drop to be ejected becomes analogically variable between the small ink drop and the large drop mentioned before by changing the pulse voltage and the wave form to be applied. By changing the pulse voltage and the wave form to be applied in a manner similar to that of ejecting a large ink drop, for example, a 100 $\mu$m diameter ink drop can be easily ejected.

Besides, according to this embodiment, since a structure of means 6 for drawing the ink front position inward and means 7 for pushing it outward being completely separated from ink 2 is obtained by use of a vibrating plate 9, an element subject to deterioration due to moisture as employed especially as piezoelectric actuator 10 is prevented from being deteriorated, thereby enabling the ink front position control to be enhanced in reliability.

Incidentally, in this embodiment, piezoelectric actuators 10 are used as draw-in means 6 and push-out means 7, but the present invention is not limited to this and magnetostrictive elements can be used in place of piezoelectric actuators. Furthermore, even if having desired characteristics, a decompressor and a heat source can be used as means for drawing the ink front position to inside the flow passage 5 and as means for pushing it outward, respectively.

Furthermore, the flow passage diameter used in this embodiment is one embodiment and the size of an ink drop 8 to be ejected can be changed by a change in dimensions and shape.

Embodiment 1-2

Figure 5:
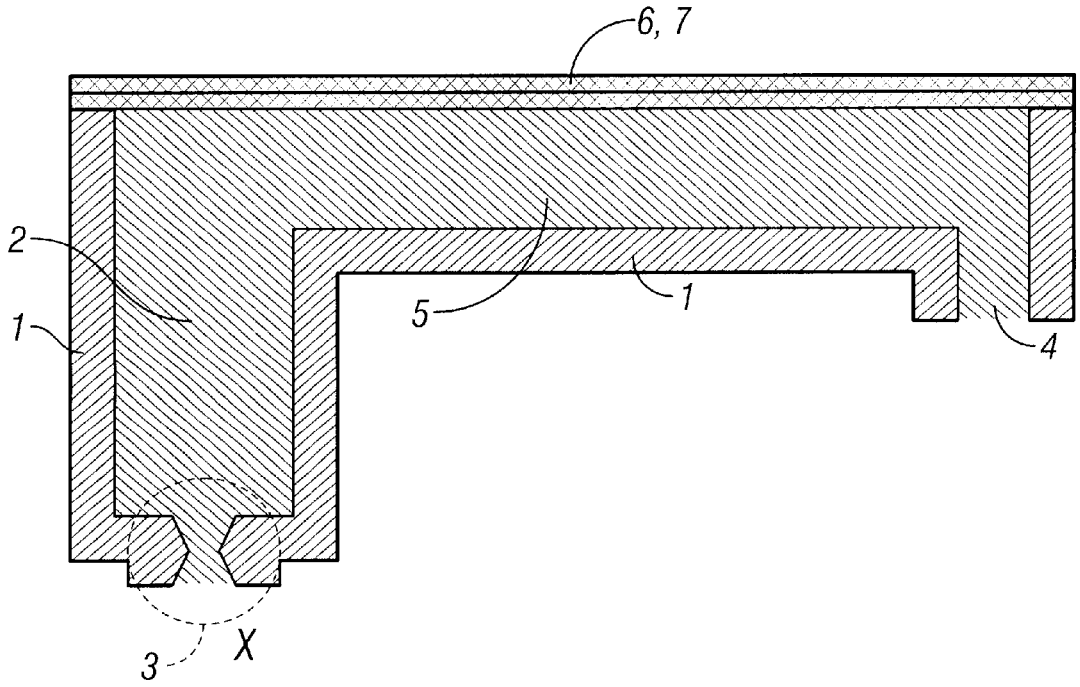
FIG. 5 is a schematic sectional view of an ink-jet printer according to another embodiment of the present invention.

With respect to Embodiment 1 of the present invention, another embodiment will be described, but FIG. 5 is a block diagram showing this embodiment. Here, to corresponding locations related to individual parts so arranged as with FIG. 1 are attached like symbols.

The difference of this embodiment from Embodiment 1 lies in that a direct bond type monocrytalline piezoelectric substrate is used as piezoelectric actuator 10.

In this embodiment, a substrate joined of lithium niobate substrates 6 and 7 inverted in polarized direction is used as direct bond type piezoelectric actuator. Besides, on both faces of this two-sheet-joined lithium niobate substrate, unshown electrodes are formed by use of evaporation. No vibrating plate 9 in FIG. 1 is used.

The direct bond method used here comprises subjecting a hydrophilic treatment to two mirror-ground inorganic substrates to generate a hydrophilic group such as OH group on the surface, bringing both faces into direct face contact with each other and joining two inorganic substrates by heat treatment. And, the direct bond means a firm bond of atomic level such as hydrogen bonding with an OH group of the bond surface formed by this treatment, covalent bonding between elements or via oxygen originating from OH groups constituting the respective substrate surfaces or ionic bonding.

For some substrate materials, an oxide film may be formed at the bond interface to serve as a buffer layer during the direct bond treatment. At present, these materials include silicon, quartz, glass, crystal, lithium niobate, lithium tantalate and lithium boronate.

Next, the operating principle of this monocrystalline piezoelectric actuator 10 is basically similar to that of Embodiment 1 and is represented by a process that a bending displacement occurs as shown in FIG. 2(*a*) or (*b*) by application of a pulse voltage.

The difference from Embodiment 1 is broadly divided into two points. One point is that, since two monocrystalline substrates are joined together with the polarization inverted, application of a pulse voltage causes one piezoelectric substrate to extends and the other to contract, thereby resulting in the occurrence of bending displacement as a whole piezoelectric actuator 10, while the other point is that the dispersion of characteristics is very small and the controllability of an actuator is very good since a monocrystalline piezoelectric substrate is joined by using the direct bond method.

From these it follows that, according to this embodiment, an effect similar to that of Embodiment 1-1 can be obtained. Besides, the controllability of an actuator is a very important factor in precisely controlling the ink front position and use of this direct bond type actuator enables ink drops to be ejected better in controllability than in Embodiment 1-1, so that high quality images can be stably obtained.

Embodiment 1-3

Hereinafter, Embodiment 1-3 of the present invention will be described referring to the configuration drawing of FIG. 6. Here, like symbols are attached to individual parts that can be arranged as with Embodiment 1-1.

This embodiment differs from Embodiment 1-1 in that the wall face of a flow passage 5 near the ejection port 3 is elliptic. This change in shape near the ejection port brings about a difference in ejecting operation.

Next, this ejecting operation will be described referring to FIGS. 7 and 8.

Figure 6:
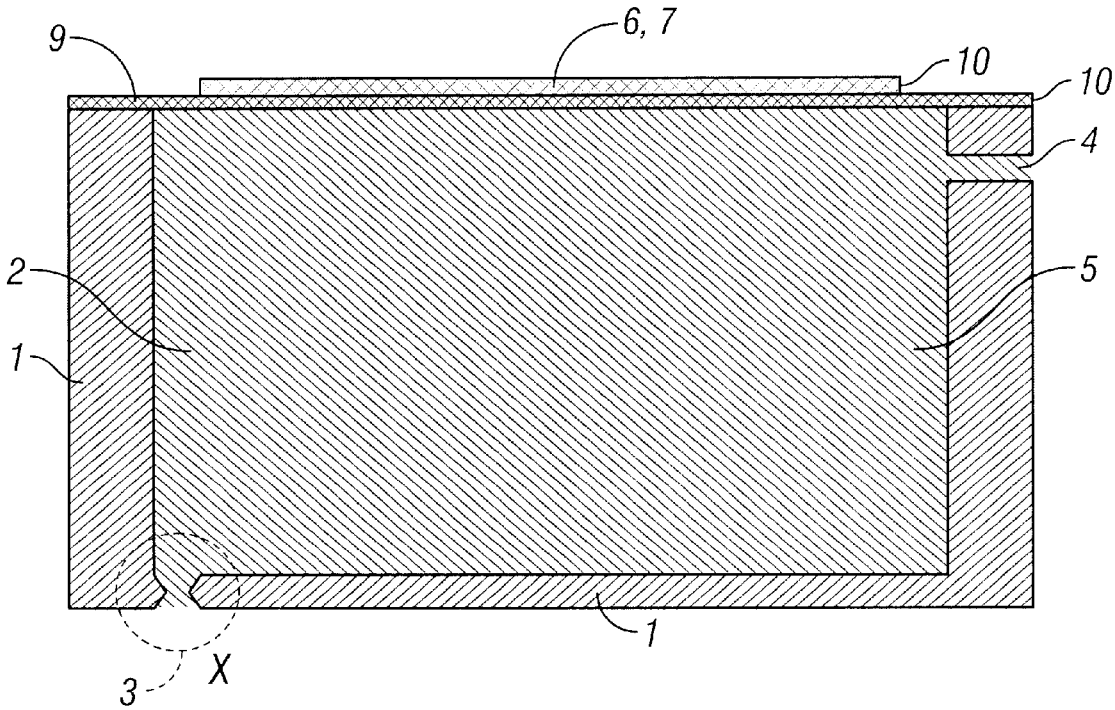
FIG. 6 is a schematic sectional view of an ink-jet printer according to yet another embodiment of the present invention.
Figure 7A:
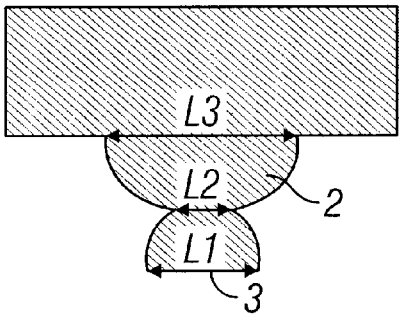
FIG. 7 is an illustration showing the ejecting operation in ejecting a small ink drop according to one embodiment of the present invention.
Figure 7B:
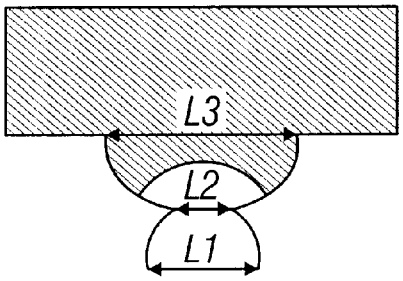
Figure 7C:
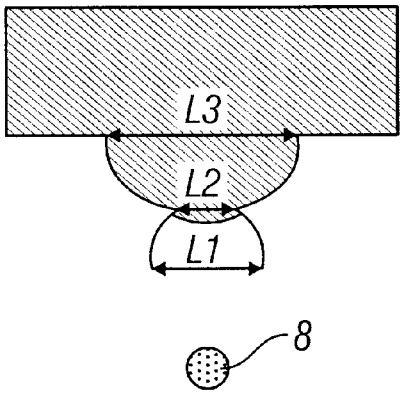

First, FIG. 7 is an enlarged view of the X1 portion of FIG. 6 and shows the operating principle for ejecting small ink drops from the ejection port 3. This embodiment has sections of L1, L2 and L3 in diameter from the ejection port toward the inside of the flow passage 5 and the resultant change in sectional shape becomes elliptic.

FIG. 7(*a*) shows the initial value of ink front position at a time when no control of the ink front position is made. As with Embodiment 1-1, a pulse voltage is applied to a piezoelectric actuator 10, thus causing the ink front position to retreat from the location of flow passage diameter L2, further inside the flow passage 5 as shown in FIG. 7(*b*). Then, by applying an inverted pulse voltage to the actuator 10, the ink front position is pushed out outside the flow passage 5 and ink is ejected as a small ink drop 8 from a section location of flow passage diameter L2. Next, FIG. 8 is an enlarged view of the X portion of FIG. 6 as with FIG. 7 and shows the operating principle for ejecting large ink drops from the ejection port 3. Besides, the shape of a flow passage near the ejection port is similar to that of FIG. 6.

Figure 8A:
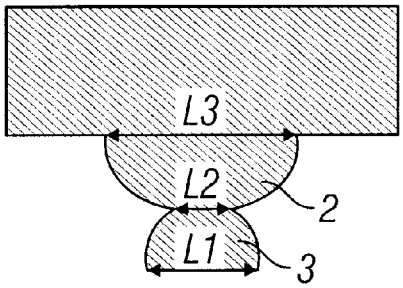
FIG. 8 is an illustration showing the ejecting operation in ejecting a large ink drop according to one embodiment of the present invention.
Figure 8B:
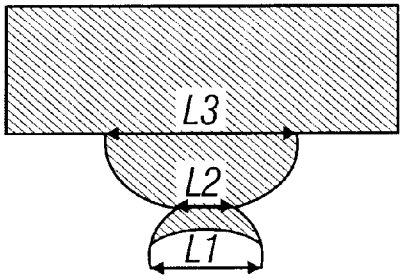
Figure 8C:
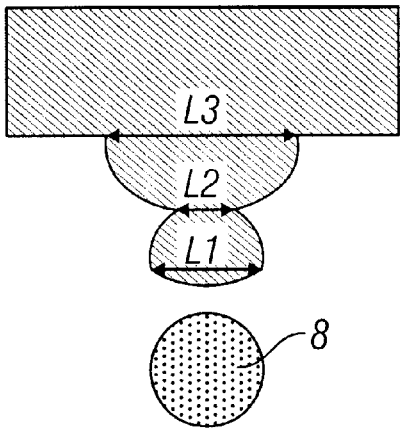

FIG. 8(*a*) shows the initial value of ink front position at a time when no control of the ink front position is made. As with Embodiment 1-1, a pulse voltage is applied to a piezoelectric actuator 10, thus causing the ink front position to retreat to a location between the flow passage diameters L1 and L2 as shown in FIG. 8(*b*). Then, by applying an inverted pulse voltage to the actuator 10, the ink front position is pushed out outside the flow passage as shown in FIG. 8(c) and ink is ejected as a large ink drop 8 from a section location of flow passage diameter L1.

In this embodiment, for example, the shape of a flow passage near the ejection port is taken as L1: 120 $\mu$m, L2: 80 $\mu$m and L3: 250 $\mu$m and the driving conditions are defined as pulse voltage: ±25V and driving frequency: 3 kHz.

On driving operation by using a method for ejecting small ink drops under these conditions, a smaller ink drop of about 55 $\mu$m than the diameter of L2 is ejected from the section of the flow passage L2. This is considered as: by changing the section of the flow passage from L3 to L2, the flow speed of ink is accelerated near the center of L2, the speed distribution is concentrated in the portion of a smaller section than the section of L2 and consequently ink is thought to be ejected as a small ink drop. Furthermore, it is attributable to a further deviation of the flow velocity to the center by changing the flow passage wall into an elliptic shape that the ejected ink drop becomes smaller than observed in Embodiment 1-1.

Next, on similar driving operation by using a method for ejecting larger ink drops, a larger ink drop of about 130 $\mu$m than the diameter of L1 is ejected from the section of the flow passage L1. This is considered because, by elliptically changing the section from L2 to L1, the speed distribution near L1 becomes uniform and as a result, ink is ejected as a larger ink drop 8 than the flow passage diameter. Besides, in this embodiment, since the velocity distribution at the ejection port is constant unlike Embodiment 1-1, the magnification of an ink drop 8 to the nozzle diameter decreases but a constant velocity distribution permits a stabler ejection to be obtained than observed in Embodiment 1-1.

According to this embodiment, as shown above, an effect similar to that of Embodiment 1-1 can be obtained. Besides, since, by a change in flow passage shape near the ejection port, the modulation range of ejected ink drops 8 shifts to a smaller region, the image formation using finer dots becomes possible, thus leading to a still higher image quality.

Next, Embodiment 2 of the present invention will be described.

This embodiment is characterized in that the flow passage wall surface with an increase in sectional area from the portion of the minimum sectional area toward the interior of the flow passage is made hydrophilic or in that the flow passage wall surface with a decrease in the sectional area from the ejection port toward the interior of the flow passage, until the minimum sectional area is made water-repellant.

The embodiments of Embodiment 2 will be described.

Embodiment 2-1

Hereinafter, Embodiment 2 will be more specifically described referring to FIG. 9.

This ink-jet printer has an ink supply port 4 and an ejection port 3 on the flow passage frame 1. In the flow passage inside the ejection port 2, a heater is provided as means 7 for pushing out an ink to the outside of the flow passage, a pulse voltage is applied to an electrothermal conversion element corresponding to this part to boil ink 2 and an ink drop 8 is ejected from the ejection port. Besides, outside the ink supply port 4, a pump is provided as means for drawing in an ink drop to the interior of the flow passage.

Besides, by a deposition of a silicon dioxide film onto a part of the flow passage wall near the ejection port 3 by the sputtering process, the part is made hydrophilic. The hydrophilic place of the flow passage wall will be described in the following item of operating principle.

Figure 10A:
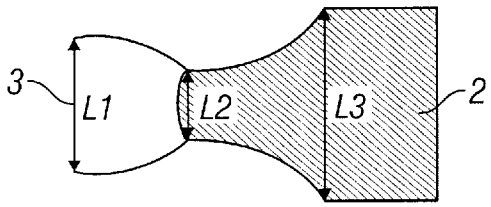
FIG. 10 is an illustration showing the ejecting operation in ejecting a small ink drop according to one embodiment of the present invention.
Figure 10B:
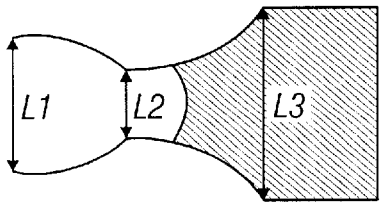
Figure 10C:
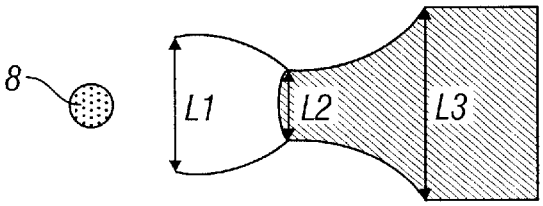
Figure 11A:
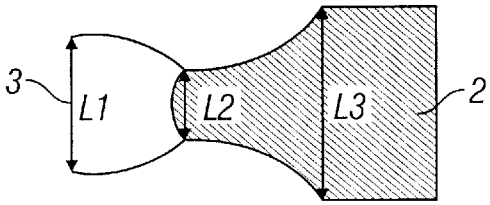
FIG. 11 is an illustration showing the ejecting operation in ejecting a large ink drop according to one embodiment of the present invention.
Figure 11B:
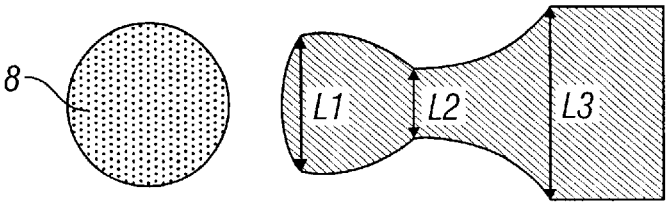

Next, the ejecting operation will be describes referring to FIGS. 10 and 11.

Figure 9:
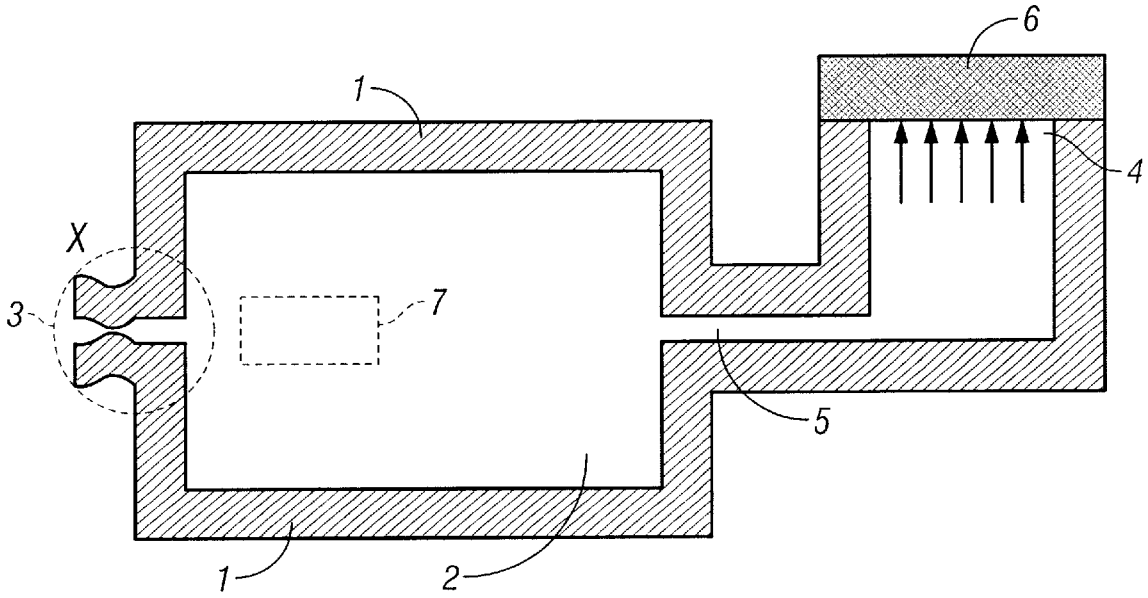
FIG. 9 is a schematic sectional view of an ink-jet printer according to yet another embodiment of the present invention.

First, FIG. 10 is an enlarged view of the X portion of FIG. 9 and shows the operating principle for ejecting small ink drops from the ejection port 3. This embodiment has sections of L1, L2 and L3 in diameter from the ejection port 3 toward the interior of the flow passage. Besides, as mentioned above, a hydrophilic treatment is performed by use of a silicon dioxide between the locations of flow passage sections L2 and L3.

FIG. 10(*a*) shows the initial value of ink front position at a time when no control of the ink front position is made. This initial value differs from that of Embodiments 1-1 to 1-3 and is situated at the location of flow passage section L2. This initial state is implemented by the presence of hydrophilicity in said part of the flow passage.

In this state, by use of a pump as means 6 for drawing the ink front position, such a control is made that the ink front position becomes the condition of FIG. 10(*b*). Then, a pulse voltage is applied to an electrothermal conversion element as means 7 for pushing out the ink front position to cause an occurrence of boiling, so that a small ink drop 8 is ejected from the section location of the flow passage L2 as shown in FIG. 10(*c*).

Next, FIG. 11 is an enlarged view of the X portion of FIG. 9 as with FIG. 10 and shows the operating principle for ejecting large ink drops from the ejection port 3. Besides, the shape of a flow passage near the ejection port is similar to that of FIG. 10.

FIG. 11(*a*) shows the initial value of ink front position at a time when no control of the ink front position is made. Like the above cases of ejecting a small ink drop, the ink front position is at the section location of the flow passage L2. With Embodiments 1-1 to 1-3, it was necessary to change the ink front position before the ejection of ink drops by using means 6 for drawing in the ink front position, but in this case the ink front position is at the section location of the flow passage L2 initially and accordingly this operation becomes unnecessary in Embodiment 2-1. Thus, without using means 6 for drawing in the ink front position, a pulse voltage is applied to an electrothermal conversion element as means 7 for pushing out the ink front position to cause an occurrence of boiling, so that a large ink drop 8 is ejected from the section location of the flow passage L1 as shown in FIG. 11(*b*).

In this embodiment, for example, the shape of a flow passage near the ejection port was taken as L1: 60 $\mu$m, L2: 30 $\mu$m and L3: 200 $\mu$m.

On driving operation by using a method for ejecting small ink drops under these conditions, a smaller ink drop of about 28 $\mu$m than the diameter of L2 was ejected from the section of the flow passage L2.

Then, on similar driving operation by using a method for ejecting large ink drops, a larger ink drop of about 63 $\mu$m than the diameter of L1 is ejected from the section of the flow passage L1.

As shown above, according to this embodiment, it is possible to eject different ink drops in size from one and the same ejection port 3 as with Embodiments 1-1, 1-2 and 1-3.

Besides, by shaping the flow passage section into a spherical surface as shown in FIGS. 10 and 11, the modulation region becomes smaller than in Embodiments 1-1, 1-2 and 1-3, but the ejection stability improves and the size of ink drops 8 can be controlled still more precisely.

Furthermore, in this embodiment the sputtering process of a silicon dioxide film was used as method for obtaining the hydrophilicity, but use of other methods for making a part of the section hydrophilic can also set the initial position at the location of the section L.

Embodiment 2-2

Hereinafter, Embodiment 2-2 of Embodiment 2 will be described referring to FIG. 12. Here, like symbols are attached to individual parts that can be arranged as with FIG. 9.

This embodiment differs from Embodiment 2-1 in the shape of a spherical wall surface of the flow passage 5 near the ejection port 3 and in the following point: whereas a part of the flow passage is treated hydrophilically in Embodiment 2-1, a part of the flow passage near the ejection port is treated water-repellently in this embodiment. The water-repellant treatment is performed by application of a water-repellant spray and the place treated water-repellently will be described in the following description of ejecting operation.

Next, the ejecting operation will be described referring to FIGS. 13 and 14.

Figure 12:
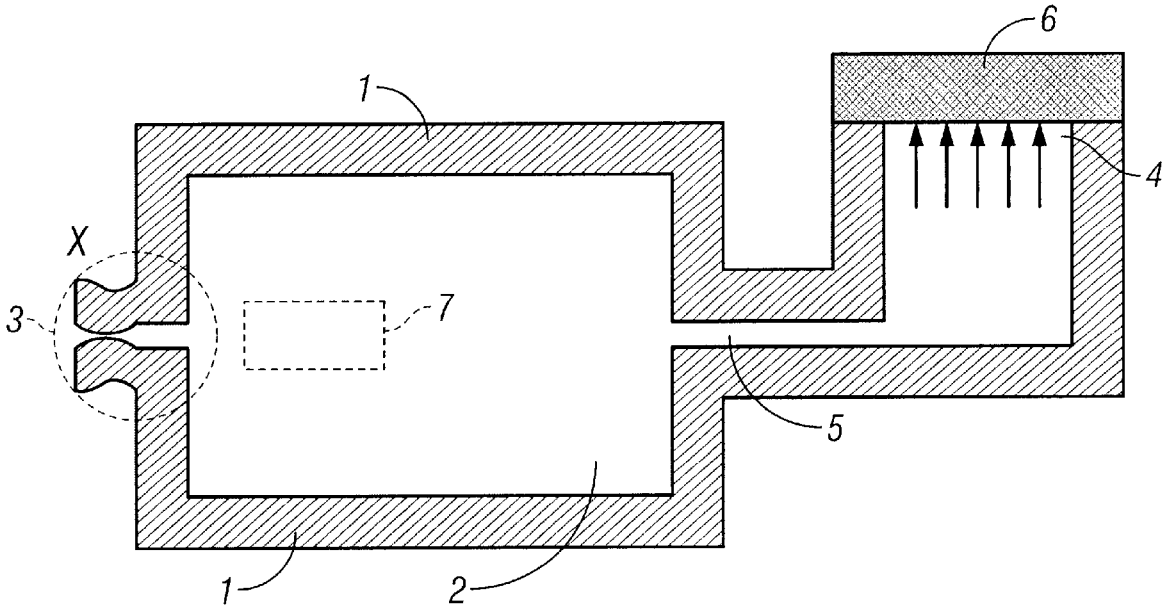
FIG. 12 is a schematic sectional view of an ink-jet printer according to yet another embodiment of the present invention.
Figure 13A:
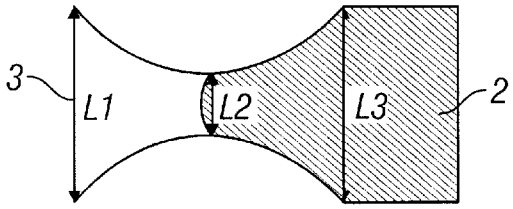
FIG. 13 is an illustration showing the ejecting operation in ejecting a small ink drop according to one embodiment of the present invention.
Figure 13B:
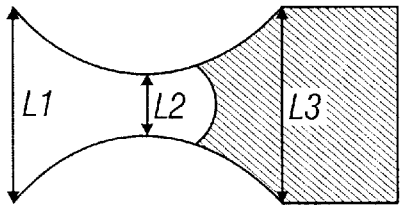
Figure 13C:
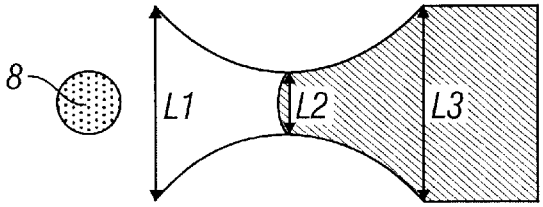
Figure 14A:
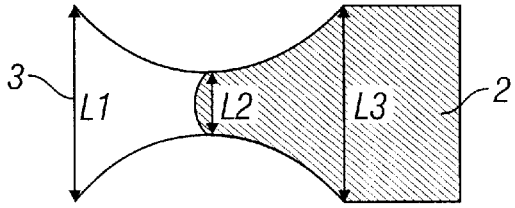
FIG. 14 is an illustration showing the ejecting operation in ejecting a large ink drop according to one embodiment of the present invention.
Figure 14B:
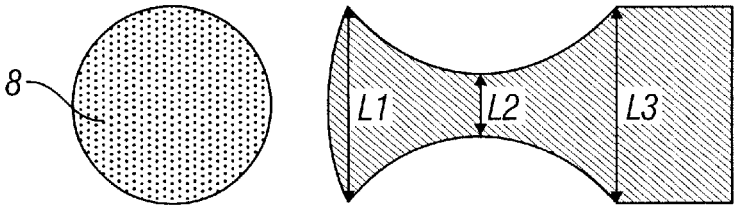

FIGS. 13 and 14 are enlarged views of the X portion of FIG. 12 and shows the operating principle for ejecting small ink drops and large ink drops from the ejection port 3. This embodiment has a flow passage shape comprising section locations of L1, L2 and L3 in diameter from the ejection port 3 toward the interior of the flow passage. Besides, as mentioned above, the water-repellent treatment is performed between the location of the flow passage section L1 and the location of the flow passage section L2 by use of a water-repellent spray.

The difference of the ejecting operation differs from Embodiment 2-1 as follows: whereas the initial state of an ink was set to the L2 section location of the flow passage by making the section from the flow passage L2 to the flow passage L3 hydrophilic in Embodiment 2-1, the initial state of an ink is positioned at the L2 section location of the flow passage by making the section from the flow passage L1 location to the flow passage L2 location water-repellant in this embodiment.

As mentioned above, according to Embodiment 2-2, an effect similar to that of Embodiment 2-1 can be obtained. Besides, a large size ink drop 8 can be further enlarged in comparison with the Embodiment 2-2 because the shape of the flow passage near the ejection port of Embodiment 2-2 has such curved form that is reverse to that of the Embodiment 2-1. Meanwhile the size of the small ink drop 8 is substantially same between the Embodiments 2-1 and 2-2. Therefore the Embodiment 2-2 can realize larger enlargement of the modulation width in an ink drop 8 than the case of Embodiment 2-1.

Besides, since the water-repellant treatment is performed near the ejection port in this embodiment, a decrease in the ink remaining near the ejection port is enabled and accordingly a stabler ejection can be carried out.

Incidentally, in this embodiment, a part of the flow passage wall is treated water-repellently to set the initial state of the ink front position to the section location of the flow passage L2, but its combination with the hydrophilic method employed in Embodiment 2-1 allows the ink front position to the positioned at the section location of flow passage L2 more securely, thus enabling a still stabler ejection to be obtained.

Next, Embodiment 3 of the present invention will be described. This embodiment is characterized in that a stepped structure is provided at the section of a portion with a change in the sectional area of a flow passage.

Embodiment 3-1

Hereinafter, Embodiment 3-1 of Embodiment 3 will be more specifically described referring to FIG. 15.

This ink-jet printer has an ink supply port 4, an ejection port 3 and a bottom opening portion on the flow passage frame 1. To the bottom opening portion, a direct bond type monocrystalline piezoelectric actuator 10 shown in Embodiment 1-2 as means 6 and 7 for changing the front position of ink to the inside and the outside of a flow passage is fastened and a vibrating plate 9 is disposed at the top. To this top vibrating plate 9, a piezoelectric ceramic substrate shown in Embodiment 1-1 as means 6 and 7 for changing the front position of ink to the inside and the outside of a flow passage is fastened. Using these top and bottom ink front position control means, a ink drop 8 with a change in mass and diameter is ejected from the ejection port 3.

Besides, a stepped structure is provided at a part of the flow passage wall near the ejection port 3. This stepped structure will be described in the next item of the ejecting operation.

Next, the ejecting operation will be described referring to FIGS. 16 and 17.

Figure 15:
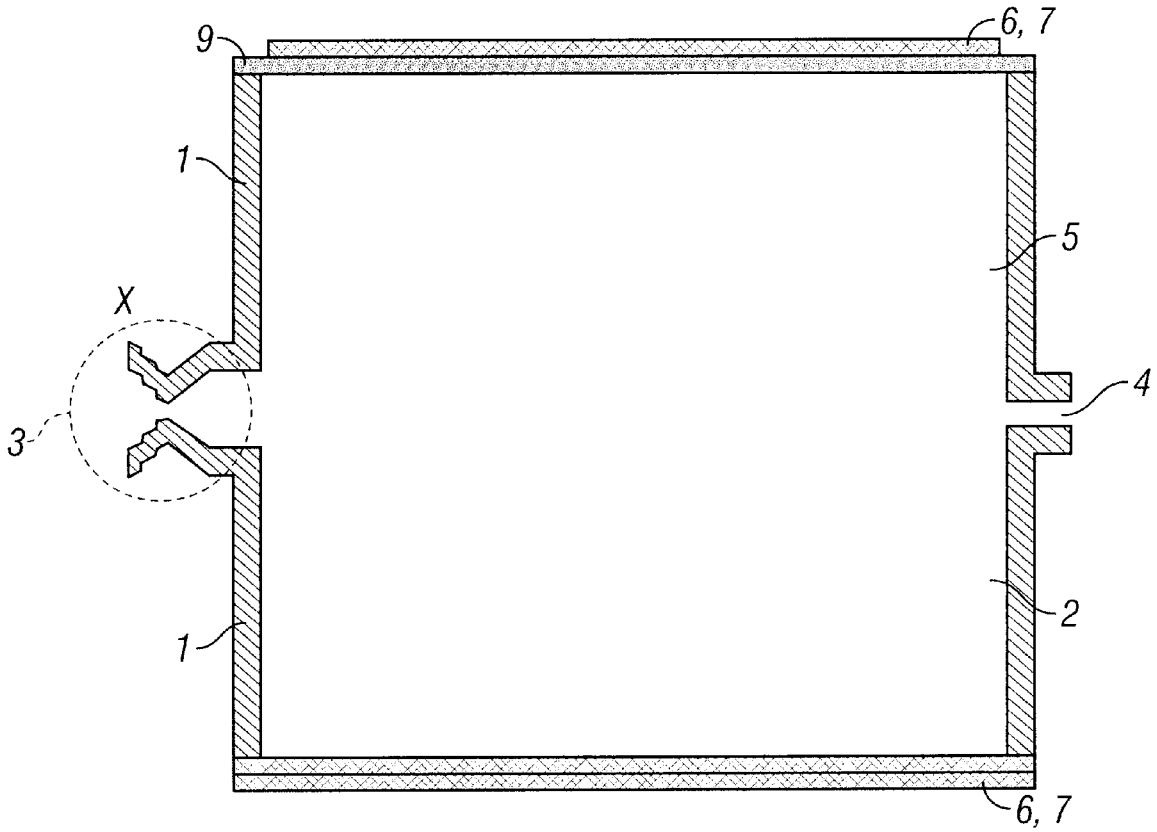
FIG. 15 is a schematic sectional view of an ink-jet printer according to yet another embodiment of the present invention.
Figure 16A:
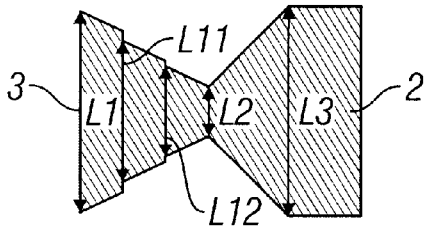
FIG. 16 is an illustration showing the ejecting operation in ejecting a small ink drop according to one embodiment of the present invention.
Figure 16B:
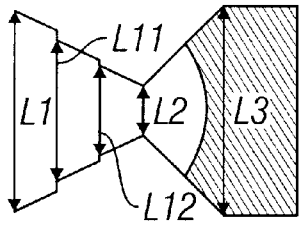
Figure 16C:
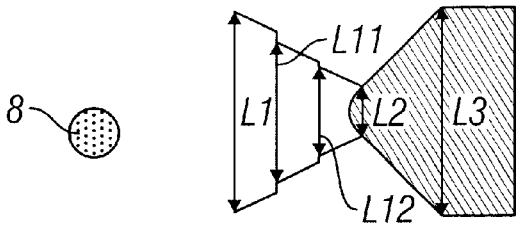

First, FIG. 16 is an enlarged view of the X portion of FIG. 15 and shows the operating principle for ejecting small ink drops from the ejection port 3. Unlike the other embodiments mentioned above, the flow passage of this embodiment takes a shape of having not only sections of L1, L2 and L3 in diameter from the ejection port toward the interior of the flow passage 5 but also two sections of L11 and L12 between the sections L1 and L2.

FIG. 16(*a*) shows the initial value (stationary state) of front position of ink at a time when no control of the front position of ink is made. In this state, when a large curved displacement is given as to lead the initial state to that shown in FIG. 2(*a*) under application of a pulse voltage to the piezoelectric actuator 10 using a piezoelectric ceramic, the front position of ink retreats to a further inner side of the flow passage 5 from the location of L2 passage diameter as shown in FIG. 16(*b*). Then, by giving a curved displacement under application of a pulse voltage to the bottom direct bond monocrystalline piezoelectric actuator 10, ink is ejected as a small drop 8 from the section location of L2 flow passage diameter as shown in FIG. 3(*c*).

Figure 17A:
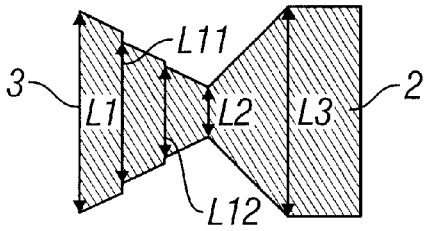
FIG. 17 is an illustration showing the ejecting operation in ejecting a large ink drop according to one embodiment of the present invention.
Figure 17B:
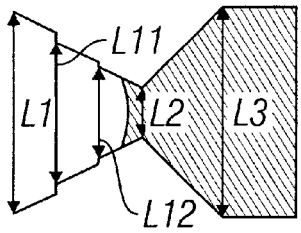
Figure 17C:
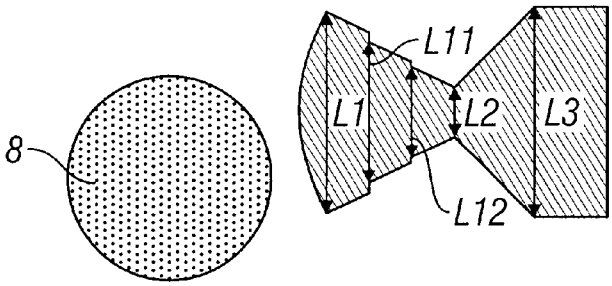

Next, FIG. 17 is an enlarged view of the X portion of FIG. 15 as with FIG. 16 and shows the operating principle for ejecting large ink drops from the ejection port 3. Besides, the shape of a flow passage near the ejection port is similar to that of FIG. 16.

FIG. 17(*a*) shows the initial value (stationary state) of front position of ink at a time when no control of the front position of ink is made. In this state, on giving a curved displacement under application of a pulse voltage to the bottom direct bond monocrystalline piezoelectric actuator 10, the front position of ink retreats to a flow passage 5 between the L2 and L3 passage diameters as shown in FIG. 17(*b*). Then, by application of a pulse voltage to the top piezoelectric actuator 10 using a piezoelectric ceramic, ink is ejected as a drop 8 from the section location of L1 or L11 or L12 flow passage diameter as shown in FIG. 17(*c*).

In this embodiment, for example, the shape of a flow passage near the ejection port was taken as L1: 120 $\mu$m, L11: 90 $\mu$m, L12: 60 $\mu$m, L2: 30 $\mu$m and L3: 200 $\mu$m and the driving conditions are defined as pulse voltage: ±15 to 50 V and driving frequency: 3 kHz.

On driving operation by using a method for ejecting small ink drops under these conditions, a smaller ink. drop of about 26 $\mu$m than the diameter of L2 is ejected from the section of the flow passage L2. This is considered as: by changing the section from L3 to L2, the flow velocity of ink is accelerated near the center of L2, consequently the velocity distribution is concentrated in the portion of a smaller portion than the section of L2 and ink is ejected as a small ink drop.

Next, on similar driving operation by using a method for ejecting larger ink drops, a larger ink drop of about 140 $\mu$m than the diameter of L1 is ejected from the section of the flow passage L1. This is considered as: by changing the section from L2 to L1, the velocity distribution spreads beyond the L1 section and as a result, ink is ejected as a larger ink drop than the L1 section.

Besides, a change in applied pulse voltage enables ink drops 8 to be ejected from the section location of the flow passage L11 or L12, ink drops of 98 $\mu$m and 65 $\mu$m diameter were ejected from the section location of the flow passage L11 or L12 respectively. Like this, the provision of a stepped structure enables ink drops of various diameters to be ejected.

As shown above, according to this embodiment, an effect similar to that of Embodiment 1-1 can be obtained. Besides, an increase in the number of stepped structures enables the mass or the diameter of an ink drop 8 to be easily changed.

Furthermore, in this embodiment, two kinds of piezoelectric substrates are used as means 6 for drawing in and means 7 for pushing out the front position of ink in ejecting a large ink drop 8 and a small ink drop 8; and more specifically, in ejecting a small ink drop 8, a piezoelectric ceramic actuator is used as draw-in means and a monocrystalline piezoelectric actuator is used as push-out means, while by contraries in ejecting a large ink drop 8, a monocrystalline piezoelectric actuator is used as draw-in means and a piezoelectric ceramic actuator is used as push-out means. Such a configuration allows the most to be made of only excellent points in characteristics of two actuators, thereby enhancing the stability during the ejection of ink drops 8.

Incidentally, in this embodiment, two piezoelectric actuators 10 are used one for each case, but they may be at the same time used together under control.

Furthermore, by a hydrophilic or water-repellent treatment of the inside wall of the flow passage 5 near the ejection port as shown in Embodiments 2-1 or 2-2, an effect similar to those of Embodiments 4 and 5 can be obtained.

Still further, by application of a well-known optimizing driving form method to the ejection of small ink drops and large ink drops, shown in Embodiments 1-1 to 3-1, the modulation width can be further enlarged.

Furthermore, even for other shapes near the ejection port than those shown in Embodiments 1-1 to 3-1, a similar effect can be obtained if a flow passage is only so shaped that the sectional area decreases from the ejection toward its interior and increases further inward beyond the portion of the minimum sectional area.

Next, Embodiment 4 will be described.

Embodiment 4 of the present invention is an ink-jet printer comprising:

(a) a flow passage with a decrease in sectional route area from the ejection port toward the interior thereof, a predetermined length of portion of a minimum sectional area and an increase from there further toward the interior;

(b) means for drawing in the front position of ink inside the flow passage; and (c) means for pushing out the front position of ink outside the flow passage.

Figure 18A:
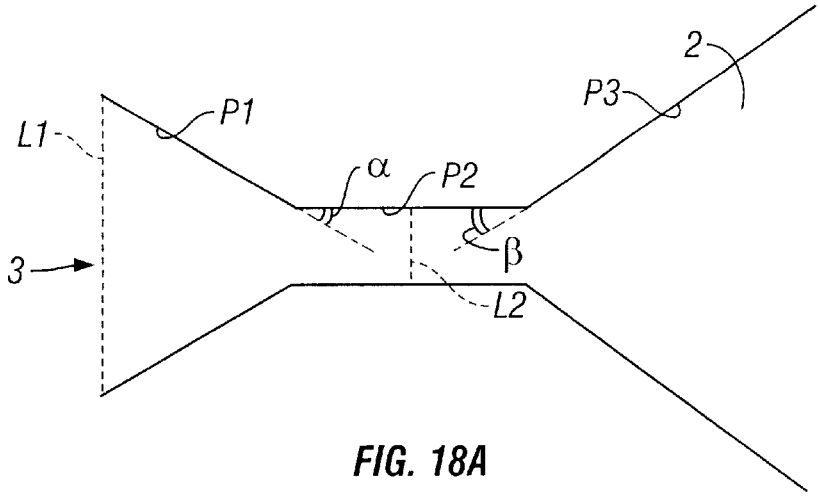
FIGS. 18(*a*), (*b*) and (*c*) are schematic sectional views of flow passages according to other embodiments of the present invention.
Figure 18B:
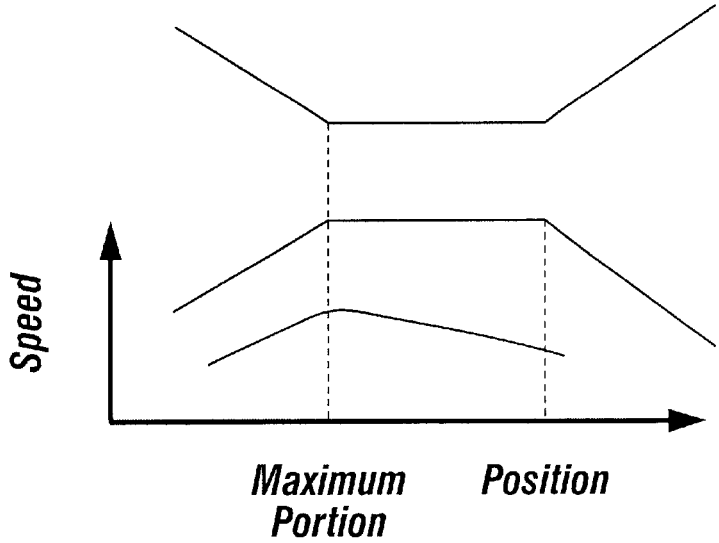
Figure 18C:
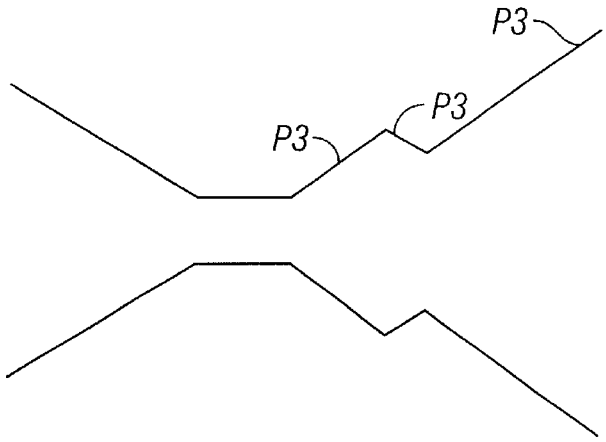
Figure 19:
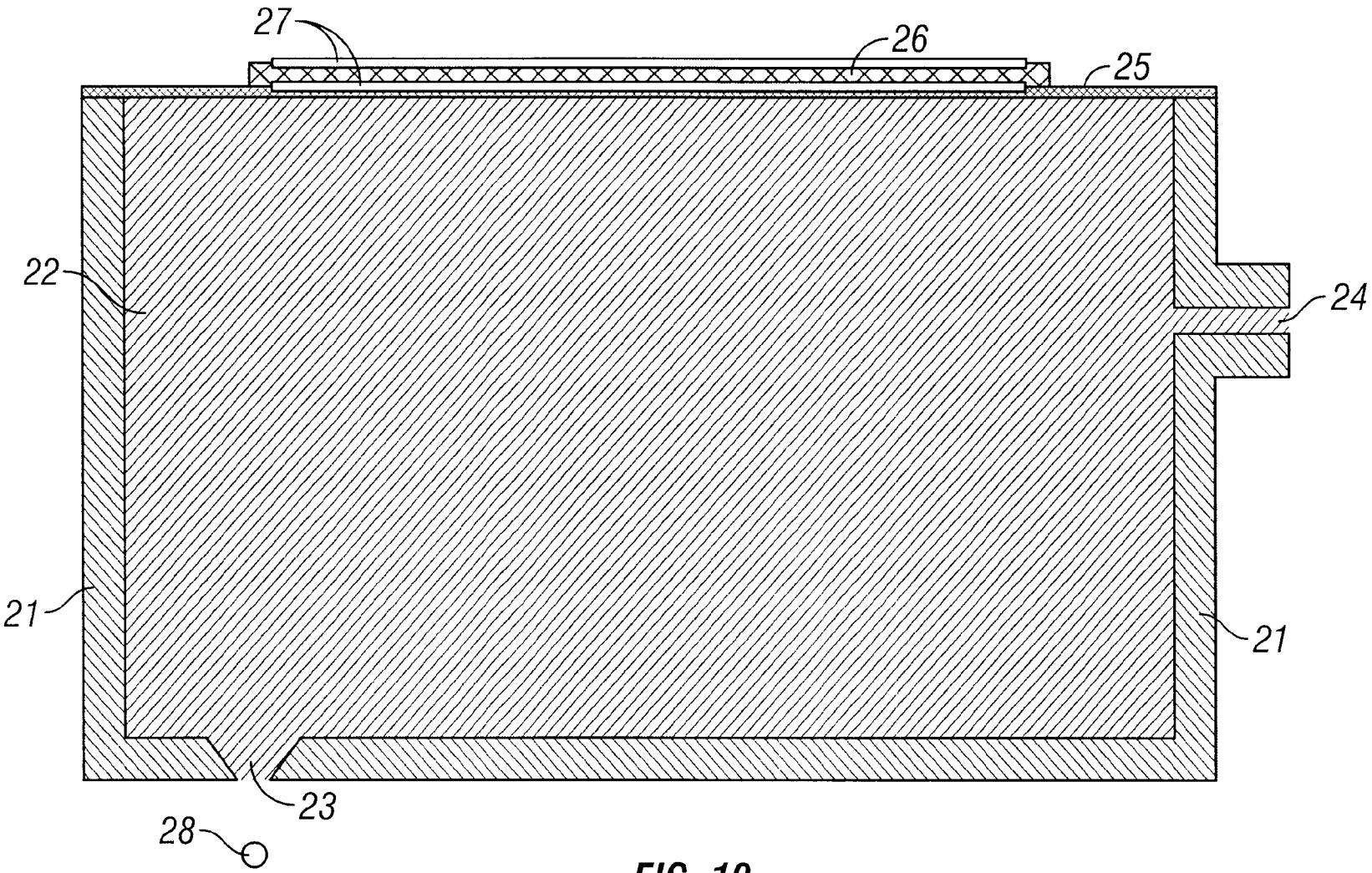
FIG. 19 (Prior Art)
FIG. 19 is a schematic sectional view of a former ink-jet printer.

FIGS. 18(*a*), (*b*) and (*c*) shows the content of the shape. In FIG. 18(*a*), Numerals P1, P2 and P3 denote the surface of a place with a decrease in sectional area from the ejection port toward the interior of the flow passage, that of a place of the minimum sectional area portion and that of a place with an increase in sectional area toward the interior of the flow passage, respectively.

The boundary between the surface P1 and the surface P2 is the edge of the minimum sectional area portion on the side of the ejection port 3 and in other words, P1 and P2 are both surfaces across this edge. And, the angle $\alpha$ made with the surface P1 and the surface P2 is desired to be 20 degree or more for the purpose of ensuring a smooth tearing in ejecting a small ink drop.

On the other hand, the boundary between the surface P2 and the surface P3 is the edge of the minimum sectional area portion on the opposite side of the ejection port 3 and in other words, P2 and P3 are both surfaces across this edge. And, the angle $\beta$ made with the surface P2 and the surface P3 is desired to be 20 degree or more for the purpose of making the so-called centeralizing effect of ink more effective.

Incidentally, since ink is centralized at the boundary between the surface P2 and the surface P3, the flowing velocity of ink increases more and more with an advance from this boundary to the ejection port side. However, when the portion of minimum sectional area has some length, the speed begins to be gradually decelerated due to the friction with its inner wall. Accordingly, the length of the minimum sectional area portion is desired to be equal or shorter than such length that theoretically ink velocity becomes maximum. Namely, as shown in FIG. 18(*b*), it is desired that theoretically the point where the velocity becomes maximum is present at the edge of portion of the minimum sectional area on the ejection port 3 side. Of course the present invention is not restricted to this embodiment.

Incidentally, FIG. 18(*c*) shows a case where the surface P3 with an increase in sectional area is not a plane but a bent surface. Even in such a shape, the flow of ink from the surface P3 to the surface P2 side causes a centralizing tendency of ink, so that the speed increases.

Incidentally, the present invention is not applied to a general ink-jet printer, but may be used in combination with devices equipped with a printing machine such as facsimile, word processor or register. Besides, it is also applicable to apparatus used in a production line for the stamping or drawing on a manufacturing product, the application of a liquid medicine or the like. Besides, a recording medium according to the present invention may be a metal, glass, resin, porcelain, wood, cloth, skin of the like.

As mentioned above, according to the present invention, the control of ink drops by modification of the shape of the flow passage near the ejection port and by use of means for drawing in the front position of ink inside the flow passage and means for pushing it out enables a recording to be made at a higher gradation and speed than before.

Besides, a combination of a modified shape of the flow passage, a changed treatment and control means of the front position of ink enables ink drops having various characteristics to be ejected.

Furthermore, use of the present configuration can prevent the head structure of an ink-jet printer from being complicated.

What is claimed is:

1. The ink-jet printer for forming an image by ejecting ink drops from an ejection port, sticking them onto a recording medium and forming dots, comprising (a) an ejection flow passage that decreases in sectional area toward the interior of the flow passage from the ejection port to a boundary that is a minimum sectional area of the flow passage, and that thereafter increases from the boundary further toward the interior;

(b) draw-in means for drawing an ink front into the flow passage; and (c) push-out means for pushing said ink front from the flow passage, said draw-in means cooperating with said push-out means to eject a small ink drop having a diameter that is less than said minimum sectional area, said draw-in means and said push-out means cooperating such that said draw-in means draws in said ink front to a place in said flow passage where said sectional area increases, and thereafter said ink is pushed outward by said push-out means at such a speed as to leave from said boundary.

2. The ink-jet printer as set forth in claim 1, wherein said place of the minimum sectional area has a predetermined length and a velocity on a center line of said flow passage becomes maximum at the edge of a place of said minimum sectional area on said ejection port side.

3. The ink-jet printer as set forth in claim 2, wherein hydrophilic is a wall surface of said place with an increase in sectional area from said boundary toward the flow passage interior.

4. The ink-jet printer as set forth in claim 3, wherein water-repellant is a wall surface of said place with a decrease in sectional area from said ejection port toward the boundary.

5. The ink-jet printer as set forth in claim 4, wherein a wall surface of said flow passage where the sectional area changes, has a stepped structure.

6. The ink-jet printer as set forth in claim 5, wherein a wall surface of said flow passage where the sectional area changes, has curved surface.

7. The ink-jet printer as set forth in claim 6, wherein a change in the sectional area of said flow passage is continuous.

8. The ink-jet printer as set forth in claim 7, wherein means serves as both said draw-in means and said push-out means.

9. The ink-jet printer as set forth in claim 8, wherein by appropriately selecting the ink front position within said ejection flow passage during the waiting condition of printing, the size of a dot is selected.

10. The ink-jet printer as set forth in claim 1, wherein hydrophilic is a wall surface of said place with an increase in sectional area from said boundary toward the flow passage interior.

11. The ink-jet printer as set forth in claim 10, wherein water-repellant is a wall surface of said place with a decrease in sectional area from said ejection port toward the boundary.

12. The ink-jet printer as set forth in claim 11, wherein a wall surface of said flow passage where the sectional area changes, has a stepped structure.

13. The ink-jet printer as set forth in claim 12, wherein a wall surface of said flow passage where the sectional area changes, has curved surface.

14. The ink-jet printer as set forth in claim 13, wherein a change in the sectional area of said flow passage is continuous.

15. The ink-jet printer as set forth in claim 14, wherein means serves as both said draw-in means and said push-out means.

16. The ink-jet printer as set forth in claim 15, wherein by an appropriately selecting the ink front position within said ejection flow passage during the waiting condition of printing, the size of a dot is selected.

17. The ink-jet printer as set forth in claim 1, wherein water-repellant is a wall surface of said place with a decrease in sectional area from said ejection port toward the boundary.

18. The ink-jet printer as set forth in claim 1, wherein a wall surface of said flow passage where the sectional area changes, has a stepped structure.

19. The ink-jet printer as set forth in claim 1, wherein a wall surface of said flow passage where the sectional area changes, has curved surface.

20. The ink-jet printer as set forth in claim 1, wherein a change in the sectional area of said flow passage is continuous.

21. The ink-jet printer as set forth in claim 1, wherein means serves as both said draw-in means and said push-out means.

22. The ink-jet printer as set forth in claim 1, wherein by an appropriately selecting the ink front position within said ejection flow passage during the waiting condition of printing, the size of a dot is selected.

23. An ink-jet printer for forming an image by ejecting ink drops from an ejection port, sticking them onto a recording medium, and forming dots, said printer comprising:

an ejection flow passage, said ejection flow passage having a first passage portion that decreases in sectional area in a direction toward an interior of said flow passage away from said ejection port, a second passage portion that has a minimum sectional area, and a third passage portion that thereafter increases from said second passage portion further toward said interior in said direction, said second passage portion connecting said first and third passage portions;

draw-in means for drawing an ink front into said flow passage; and push-out means for pushing the ink front from said flow passage, said draw-in means cooperating with said push-out means such that when ejecting a small ink drop, said draw-in means draws the ink front into said third passage portion, and thereafter the ink is pushed outward by said push-out means at such a speed as to leave from said second passage portion, wherein said first passage portion has a first surface and said second passage portion has a second surface, and an angle formed by an imaginary projection of said first surface into said second passage portion and said second surface is 20 degrees or more, and wherein said third passage portion has a third surface, and an angle formed by an imaginary projection of said third surface in a direction opposite said direction into said second passage portion and said second surface is 20 degrees or more.

24. The ink-jet printer as set forth in claim 23, wherein hydrophilic is a wall surface of said third passage portion.

25. The ink-jet printer as set forth in claim 24, wherein water-repellant is a wall surface of said first passage portion.

26. The ink-jet printer as set forth in claim 25, wherein a wall surface of said ejection flow passage has a stepped structure.

27. The ink-jet printer as set forth in claim 26, wherein a wall surface of said ejection flow passage has a curved surface.

28. The ink-jet printer as set forth in claim 27, wherein a change in sectional area of said ejection flow passage is continuous.

29. The ink-jet printer as set forth in claim 28, wherein means serves as both said draw-in means and said push-out means.

30. The ink-jet printer as set forth in claim 29, wherein by appropriately selecting the ink front position within said ejection flow passage during the waiting condition of printing, the size of a dot is selected.

* * * * *